US006193122B1

(12) United States Patent
Buckley

(10) Patent No.: US 6,193,122 B1
(45) Date of Patent: Feb. 27, 2001

(54) RIGID FRAME TOOL BELT ASSEMBLY

(76) Inventor: Gregory R. Buckley, 4277 S. Richfield St., Aurora, CO (US) 80013

( * ) Notice: Subject to any disclaimer, the term of this patent is extended or adjusted under 35 U.S.C. 154(b) by 0 days.

(21) Appl. No.: 09/476,338

(22) Filed: Jan. 3, 2000

(51) Int. Cl.[7] ..... A45F 5/00
(52) U.S. Cl. ..... 224/270; 224/272; 224/678
(58) Field of Search ..... 224/270, 272, 224/665, 674, 678, 663

(56) References Cited

U.S. PATENT DOCUMENTS

| | | | | |
|---|---|---|---|---|
| 1,109,161 | * | 9/1914 | Chindgren | 224/665 |
| 2,987,231 | * | 6/1961 | Lewis | 224/663 |
| 4,325,503 | * | 4/1982 | Swinney | 224/250 |
| 4,452,383 | * | 6/1984 | Marttinen | 224/208 |
| 5,052,603 | * | 10/1991 | Spina | 224/270 |
| 5,060,836 | * | 10/1991 | Bradford et al. | 224/271 |
| 5,067,643 | * | 11/1991 | McKinney | 224/197 |
| 5,170,918 | * | 12/1992 | Perron | 224/663 |
| 5,261,584 | * | 11/1993 | Albert | 224/270 |
| 5,441,186 | * | 8/1995 | Halligan | 224/159 |
| 5,511,705 | * | 4/1996 | Dreszer | 224/252 |
| 5,511,706 | * | 4/1996 | Hendrickson | 224/269 |
| 5,711,467 | * | 1/1998 | Brown | 224/248 |
| 5,944,242 | * | 8/1999 | Musarella et al. | 224/667 |

* cited by examiner

*Primary Examiner*—Stephen P. Garbe
(74) *Attorney, Agent, or Firm*—Edwin H. Crabtree; Ramon L. Pizarro; Donald W. Mavgolis

(57) ABSTRACT

A rigid frame tool belt assembly for suspending one or more multiple tool holders. The rigid frame tool belt assembly holds the tool holders out and away from a workman's body. The belt assembly allows for free and unobstructed movement of the body when wearing the belt assembly. The belt assembly includes a belt with attached rigid frame. The belt is secured around the workman's waist. The belt is of a wide padded design for the workman's comfort while supporting the weight of the tool holders from the rigid frame. The belt also has a quick attach and detach buckle with male and female members. The male and female members are releasably attached to extension straps. The straps are attached to opposite ends of the belt. The length of the extension straps is adjustable, from the belt to the male and female members, therefore allowing adjustment for different workman waist sizes. The rigid frame is also adjustable in size for different workman waist sizes. This feature enables the workman to keep the tool holders at the same distance from his body while accommodating different waist sizes. Also the adjustable rigid frame enables the tool holder to hold a large number of tools in one position relative to the workman's body for easier access to a set of tools while in use.

11 Claims, 1 Drawing Sheet

RIGID FRAME TOOL BELT ASSEMBLY

BACKGROUND OF THE INVENTION (a) Field of the Invention

The present invention relates generally to devices that are worn around the waist of a person for the purpose of carrying items: that are required to distribute, to consume, work with, or a type of tool to accomplish a task. The requirement of easy and immediate access to these items is of great importance to the person carrying some type of holder. More specifically this invention relates to an improvement in the capacity for both size and weight of the holder. This is accomplished by supporting the weight of the holder on the person's waist similar to a large and heavy backpack, and to suspend the holders away from the body allowing complete freedom of movement of the person, and to increase stability of the holder while the person wearing it is walking.

(b) Discussion of Prior Art

For many years, persons whose occupation required tasks to be performed in a variety of positions or locations have desired to have easy and portable access to the items that they used frequently, whether it is tools, or things they consume such as nails, fasteners, food and the like, or things that are distributed such as brochures and flyers.

In the past the typical solution was to mount some type of holder on a belt worn around the waist. Although this accomplished the task, there were problems with the belt being unevenly loaded causing it to slip on the waist or be uncomfortable for the person wearing the belt. Another problem was the instability of holder while walking, as the holder would tend to bounce with the wearers walking stride possibly causing the contents of the holder to dislodge, become disorganized, or fall out of the holder.

One example of successfully addressing the problem of carrying significant weight by a person, is the wide padded waist belt commonly used for large backpacks. By distributing the weight over a large area, the belt greatly increases the comfort of the person carrying the weight and eliminates "digging in" of the belt into the waist of the person that can quickly become uncomfortable. Other waist mounted carrying and supporting holders tend to mount the holders close to the body of the person wearing the holders. This restricts physical movement of the person and adds to the instability of the holder from the hip and leg movement of the person walking with the holder mounted to their waist. The prior devices in this area do accomplish their purpose in carrying items. However, there remains a need for a way to increase capacity of the waist mounted holders and provide for greater ease of physical bodily movement of the person wearing the holder, while maintaining ease of access to the particular items carried.

SUMMARY OF THE INVENTION

In view of the foregoing, it is a primary object of the present invention to provide a new and useful rigid frame tool belt assembly for suspending one or more multiple tool holders.

Another object of the present invention is the belt and frame assembly suspends the tool holders out and away from a workman's body.

Still another object of the present invention is the belt assembly allows for free and unobstructed movement of the body when wearing the belt assembly.

Yet another object of the present invention is the elimination of the tool holders banging against the workman's moving legs while walking. This reduces vertical movement of the tool holder, reducing the opportunity for tools to eject from the tool holder and thereby being lost or misplaced.

Still yet another object is for the rigid frame to transmit the tool holder weight to a wide padded waist worn belt. The belt allows for distribution of the load over a large area on the workman's waist, allowing for heavier tools to be carried in the holders, while not impeding the workman's comfort or movement. This is similar to the concept behind large, high capacity backpacks.

A further object of the present invention is to provide for full waistline adjustability for the person wearing the belt, this is accomplished by full waist size adjustability through sliding the belt extension straps to the desired belt tension. The rigid frame is designed to fully accommodate the belt waist size adjustment as required by the person using the invention.

However, an added benefit of the present invention is the easy accessibility of what is being carried in the holders. As opposed to a backpack where accessibility of the items carried requires removal of the backpack from the person to gain access to the items carried. A padded support belt includes a quick attach and detach male and female members, for the user to take the belt on and off easily and quickly.

The belt assembly includes a belt with attached rigid frame. The belt is secured around the workman's waist. The belt is of a wide padded design for the workman's comfort while supporting the weight of the tool holders from the rigid frame. The belt also has a quick attach and detach buckle with male and female members. The male and female members are releasably attached to extension straps. The straps are attached to opposite ends of the belt. The length of the extension straps is adjustable, from the belt to the male and female members, therefore allowing adjustment for different workman waist sizes. The rigid frame is also adjustable in size for different workman waist sizes. This feature enables the workman to keep the tool holders at the same distance from his body while accommodating different waist sizes. Also the adjustable rigid frame enables the tool holder to hold a large number of tools in one position relative to the workman's body for easier access to a set of tools while in use.

These and other objects of the present invention will become apparent to those familiar with various types of tool carrying devices from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principals thereof, and in which.

DESCRIPTION OF THE PREFERRED EMBODIMENTS

The present invention relates to belt mounted tool holders designed to carry a variety of items such as pliers, screwdrivers, tape measures, hammers, levels, nails, wrenches, sheet metal cutters, and the like. To make the belt mounted tool holder more usable it is desired that a higher capacity exist to carry more and larger tools which results in increased weight, however it is preferable that the increased weight and size of the tool holder not impede the mobility of the person. The present invention addresses these goals by suspending the tool holders away from the persons body and distributes the tool holders weight over a large area on the persons waistline by use of a wide padded belt.

Figure 1:
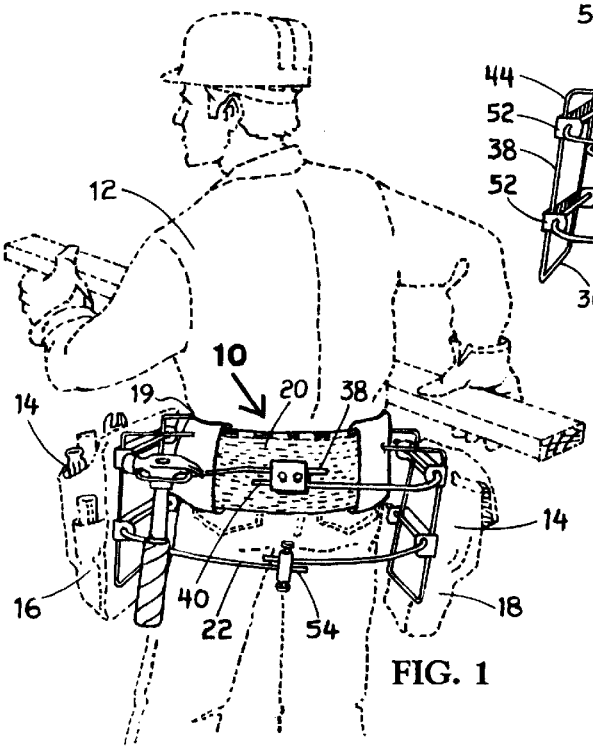
FIG. 1 is a rear view of the subject belt assembly, including a belt with a rigid frame attached thereto. The rigid frame is adapted for supporting one or more tool holders used by a workman.

In FIG. 1, a perspective view of the subject rigid frame tool belt assembly is shown for supporting tool holders being used by a workman. The tool belt assembly is shown having general reference numeral 10. The belt assembly 10 is shown received around a waist of a workman 12. The belt assembly 10 is adapted for a carrying a set of tools 14 that are carried in a first tool holder 16 and a second tool holder 18. The belt assembly 10 is generally shown in use in FIG. 1 with the workman 12 carrying tools 14 in the tool holders 16 and 18. It can be observed that the tool holders 16 and 18 are suspended a distance away from the waist 19 of the workman 12. This suspension distance allows the workman 12 freedom of movement, such as walking, climbing steps, and ascending and descending ladders while performing various tasks. A wide padded belt 20 distributes the weight of the tools 14 in the first end tool holder 16 and a second end tool holder 18, over a wide area of the workman's waistline. This is similar to the way a large heavy backpack distributes its weight on a wide padded waist belt with very little weight being supported by the shoulders of the wearer of the backpack. The wide, padded backpack waist belt is a proven method of enabling a person to carry heavy loads with minimal discomfort.

It should be understood that the present invention is not limited to carrying tools, but could be used in any situation where a quantity of large, bulky, and heavy items are required for ready access by a person. For example flyers and leaflets could be carried, or food and water, or any use where ready access to the items being carried is required. This is as opposed to a backpack that can carry large quantities and weights, but does not have easy access to the contents of the backpack. Thus the backpack must be taken off of the person wearing it, in order to gain access to the contents, adding time and inconvenience to the wearer.

Figure 2:
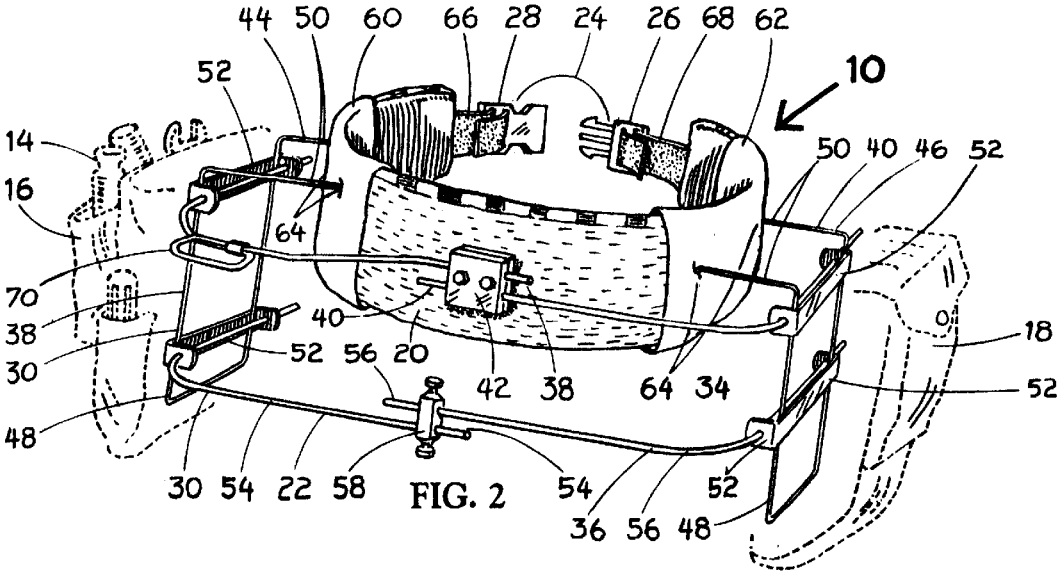
FIG. 2 is an enlarged rear perspective view of the belt assembly showing the detailed structure making up the invention.

In FIG. 2, a rear perspective view of the belt assembly 10 is illustrated. The workman 12 is not shown in this drawing. The rigid frame tool belt assembly 10 includes a rigid frame 22. The frame 22 is made of a suitable rigid material made of either metal or plastic or like materials. The first end tool holder 16 and the second end tool holder 18 are adapted to attach to the frame 22. The frame 22 suspends the tool holders 16 and 18 away from the belt assembly 20. The belt assembly 20 is secured around the workman's waist 19 by use of a buckle 24. The buckle 24 has a male member 26 and a female member 28 that securely interconnect and interlock, and also easily disconnect around the waistline 19 of the workman 12. The belt 20 is of sufficiently rigid construction in an axis parallel to the belt length to distribute the weight of the tool holder evenly over the workman's waistline. To enhance the comfort of the belt 20 to the workman 12 wearing it, the belt can be encased with high-density foam padding with a protective outer cover.

The frame 22 has a first side 30 and a second side 32. Also the frame has an upper portion 34 and a lower portion 36. The upper portion 34 of the frame 22 includes a first end 38 and a second end 40 received in a slide adapter 42. The slide adapter 42 is attached to the belt 20 opposite the buckle 24. The slide adapter 42 allows the tool holders 16 and 18, to be centered to the belt assembly 20. The adapter 42 also provides for a horizontal length adjustment between the first side 38 and the second side 40. This feature controls the distance between the tool holders 16 and 18. Also this accommodates variance in waist sizes of workmen wearing the belt 20. The frame 22 also has a first side inverted L shaped component 44 and a second side inverted L shaped component 46. Both inverted L shaped components 44 and 46 have a plurality of vertical legs 48 and horizontal legs 50. The vertical legs 48 of both the first and second side inverted L shaped components 44 and 46 are attached to a plurality of brackets 52. The brackets 52 are adapted to attach to the first side tool holder 16 and a second side tool holder 18. In addition, the brackets 52 are attached the first side vertical legs 48 of the inverted L shaped components 44 and 46. The vertical legs 48 connect the upper frame portion 34 to the lower portion 36 of the frame 22. The horizontal legs 50 of both the first and second sides inverted L shaped components 44 and 46, determine the distance that the tool holders 16 and 18 are set out from the workman 12 wearing the belt 20. The lower frame portion 36 includes a first end 54 and a second end 56. The first and second ends are slidably attached by a clamp 58. The clamp 58 also in conjunction with the slide adapter 42 allows the distance between the tool holders 16 and 18 to be adjustable, thereby accommodating the waist size adjustability of the belt 20.

A first side belt sleeve 60 and a second side belt sleeve 62 are attached to termination ends 64 of respective horizontal arm 50. The first and second side belt sleeves 60 and 62, are slidably received on a portion the belt 20. The sleeves 60 and 62 allow the tool holders 16 and 18 to remain in one position relative to the workman 12, while the belt 20 accommodates different size waists for the workman 12. Other various types of attachments may be made to the frame such as a hammer holder 70 to add utility to the frame.

Figure 3:
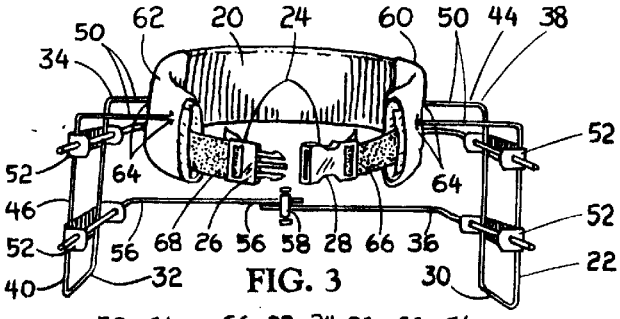
FIG. 3 is a front view of the invention with the tool holders removed for clarity.

In FIG. 3, a front view is shown of the invention with the tool holders removed for clarity. The first end upper frame 38 termination point away from the belt 20 is shown attached to the bracket 52. Likewise, the second side upper frame portion 40 termination point away from the belt 20 is shown attached to the bracket 52. The first side lower frame portion 54 termination point away from the clamp 58 is shown attached to the bracket 52. Also likewise, the second side lower frame portion 56 termination point away from the clamp 58 is shown attached to the bracket 52.

Figure 4:
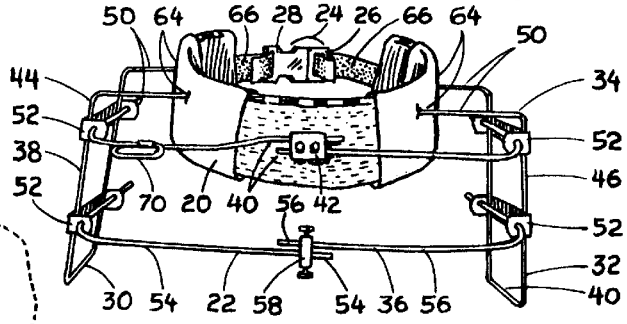
FIG. 4 is a rear view of the invention with the tool holders removed, showing in particular the belt buckle attached, and the belt assembly and frame having horizontal adjustment ability for the upper and lower frame portions.

In FIG. 4, a rear view of the invention with the tool holders removed is shown, showing in particular the buckle 24 assembled and the horizontal adjustment ability of the frame assembly 22. The buckle, which consists of the male member 26 and the female member 28, is shown in the interlocked position that secures the belt 20 around the waist of the workman 12. The slide adapter 42 provides a slidable attachment to the belt 20 for the first end upper frame portion 38 and the second end upper frame portion 40. The slide adapter 42 can accommodate any relative horizontal positioning between the first and second end upper frame portions 38 and 40. The clamp 58 provides a slidable attachment between the first end lower frame portion 54 and the second end lower frame portion 56. The clamp 58 can accommodate any relative horizontal positioning between first and second end lower frame portions 54 and 56. The adjustable horizontal frame positioning capability of the slide adapter 42 and the clamp 58 allows for the belt 20 waist size adjustment feature to function properly.

Figure 5:
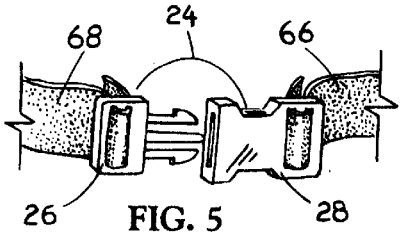
FIG. 5 shows a belt buckle with a male and a female member for securing the belt. Also shown is a first end and a second end belt extension strap adjustably connected to the male and female belt buckles.

In FIG. 5, a belt buckle 24 is shown with a male member 26 and a female member 28 for securing the belt. Also shown are a first end belt extension strap 66 and second end belt extension strap 68. Both the first and second end belt extension straps 66 and 68 are adjustably connected to the male and female belt members 26 and 28. The first end belt extension strap 66 is adjustably attached to the female member 28 of the buckle 24. The second end belt extension strap 68 is adjustably attached to the male member 26 of the buckle 24. These adjustable attachments of the belt extension straps 66 and 68 allow for waist size adjustability of the belt assembly 20 to accommodate the workman 12 using the invention 10.

Figure 6:
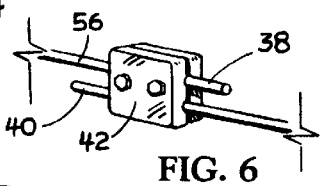
FIG. 6 shows a detail of a first end and second end of the upper portion rigid frame attachment that is slidably mounted to an adjustment adapter connected to the belt.

In FIG. 6, a detail of a first and second end upper portion frame attachment is shown that is slidably connected to the belt. The attachment 42 provides a horizontally slidable attachment for the first end upper frame portion 38 and the second end upper frame portion 40. The attachment 42 also attaches to the belt 20, not shown in this drawing, but clearly shown in FIG. 2.

Figure 7:
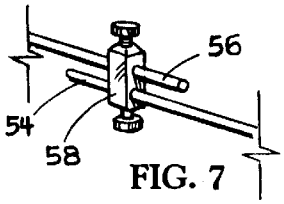
FIG. 7 shows the detail of an adjustable clamp for the lower portion frame adjustment, that slidably connects the first end and second end lower frame portions.

In FIG. 7, a detail of the retainer for the lower portion frame adjustment is shown, that slidably connects the first end and second end lower frame portions. The clamp 58 provides for a horizontally slidable adjustment of the first end lower frame portion 54 and the second end lower frame portion 56.

The frame may be but is not limited to steel rod type construction, other embodiments could be square stock, rectangular stock, various cross sectional shapes, or composites, and the like.

While the invention has been particularly shown, described and illustrated in detail with reference to the preferred embodiments and modifications thereof, it should be understood by those skilled in the art that equivalent changes in form or detail may be made therein without departing from the true spirit and scope of the invention as claimed, except as precluded by the prior art.

The embodiments of the invention for which an exclusive privilege and property right is claimed are defined as follows:

1. A rigid frame tool belt assembly for suspending one or more tool holders thereon, the belt assembly holding the tool holders out and away from a workman's waist for allowing free and unobstructed movement, the belt assembly comprising:

a belt, said belt having a belt buckle thereon;

a frame, said frame including a first side inverted "L" shaped component, said first side component having a first pair of horizontal legs, the first pair of horizontal legs attached to a first pair of vertical legs, one end of the first pair of horizontal legs attached to said belt; and a first bracket, said first bracket attached to the first pair of vertical legs of said first side component, said first bracket adapted for receiving one of the tool holders thereon.

2. The belt assembly as described in claim 1 wherein said frame includes a second side inverted "L" shaped component, said second side component having a second pair of horizontal legs, the second pair of horizontal legs attached to a second pair of vertical legs, one end of the second pair of horizontal legs attached to said belt.

3. The belt assembly as described in claim 2 further including a second bracket, said second bracket attached to the second pair of vertical legs of said second side component, said second bracket adapted for receiving one of the tool holders thereon.

4. A rigid frame tool belt assembly for suspending one or more tool holders thereon, the belt assembly holding the tool holders out and away from a workman's waist for allowing free and unobstructed movement, the belt assembly comprising:

a belt, said belt having a belt buckle thereon;

a frame, said frame including a first side inverted "L" shaped component, said first side component having a first pair of horizontal legs, one end of the first pair of horizontal legs attached to an upper end of a first pair of vertical legs, an opposite end of the first pair of horizontal legs attached to said belt; and a first bracket, said first bracket having opposite ends attached to the first pair of vertical legs of said first side component, said first bracket adapted for receiving one of the tool holders thereon.

5. The belt assembly as described in claim 4 wherein said frame includes a second side inverted "L" shaped component, said second side component having a second pair of horizontal legs, one end of the second pair of horizontal legs attached to an upper end of a second pair of vertical legs, an opposite end of the second pair of horizontal legs attached to said belt.

6. The belt assembly as described in claim 5 further including a second bracket, opposite ends of said second bracket attached to the second pair of vertical legs of said second side component, said second bracket adapted for receiving one of the tool holders thereon.

7. A rigid frame tool belt assembly for suspending one or more tool holders thereon, the belt assembly holding the tool holders out and away from a workman's waist for allowing free and unobstructed movement, the belt assembly comprising:

a belt, said belt having a belt buckle thereon;

a first side belt sleeve slidably received on a portion of said belt;

a frame, said frame having an upper frame portion and a lower frame portion, the upper and lower frame portions slidably mounted on said belt, said frame including a first side inverted "L" shaped component, said first side component having a first pair of horizontal legs, one end of the first pair of horizontal legs attached to an upper end of a first pair of vertical legs, an opposite end of the first pair of horizontal legs attached to said first side belt sleeve; and a pair of first brackets, said first brackets having opposite ends attached to the first pair of vertical legs of said first side component, said first brackets adapted for receiving one of the tool holders thereon.

8. The belt assembly as described in claim 7 wherein said frame includes a second side inverted "L" shaped component, said second side component having a second pair of horizontal legs, one end of the second pair of horizontal legs attached to an upper end of a second pair of vertical legs, an opposite end of the second pair of horizontal legs attached to a second side belt sleeve slidably received on a portion of said belt.

9. The belt assembly as described in claim 8 further including a pair of second brackets, opposite ends of said second brackets attached to the second pair of vertical legs of said second side component, said second brackets adapted for receiving one of the tool holders thereon.

10. The belt assembly as described in claim 7 wherein said frame includes a holder for a hammer.

11. The belt assembly as described in claim 7 wherein said belt is encased with high-density foam padding with a protective cover.

* * * * *